US005490485A

United States Patent [19]

Kutlucinar

[11] Patent Number: 5,490,485

[45] Date of Patent: Feb. 13, 1996

[54] ROTARY VALVE FOR INTERNAL COMBUSTION ENGINE

[76] Inventor: Iskender V. Kutlucinar, 15207 Frederick Rd., Rockwell, Md. 20850

[21] Appl. No.: 259,398

[22] Filed: Jun. 14, 1994

[51] Int. Cl.[6] ..... F01L 7/02

[52] U.S. Cl. ..... 123/190.4; 123/190.8; 123/41.4; 123/59.1; 123/80 BA; 137/624.13

[58] Field of Search ..... 123/190.1, 190.4, 123/190.8, 41.4, 59.1, 80 BA, 41.4, 59.1, 190; 137/624.13

[56] References Cited

U.S. PATENT DOCUMENTS

| | | | |
|---|---|---|---|
| 1,782,389 | 11/1930 | Rauha, Jr. et al. . | |
| 3,948,227 | 4/1976 | Guenther | 123/32 SP |
| 4,036,184 | 7/1977 | Guenther | 123/75 B |
| 4,134,381 | 1/1979 | Little | 123/190.8 |
| 4,473,041 | 9/1984 | Lyons et al. | 123/190.16 |
| 4,545,337 | 10/1985 | Lyons et al. | 123/190.16 |
| 4,739,737 | 4/1988 | Kruger | 123/190 A |
| 4,742,802 | 5/1988 | Kruger | 123/190 A |
| 4,782,801 | 11/1988 | Ficht et al. | 123/190 BD |
| 4,815,428 | 3/1989 | Bunk | 123/190.8 |
| 4,834,038 | 5/1989 | Montagni | 123/190.8 |
| 4,949,685 | 8/1990 | Doland et al. | 123/190 A |
| 5,111,783 | 5/1992 | Moore | 123/190.4 |
| 5,152,259 | 10/1992 | Bell | 123/190.2 |
| 5,197,434 | 3/1993 | Contreras Orellana | 123/190.4 |
| 5,205,251 | 4/1993 | Conklin | 123/190.12 |
| 5,257,601 | 11/1993 | Coffin | 123/73 D |

*Primary Examiner*—Henry C. Yuen
*Assistant Examiner*—Erick Solis
*Attorney, Agent, or Firm*—Tilton, Fallon, Lungmus & Chestnut

[57] ABSTRACT

A rotary valve for use in an internal combustion engine and capable of providing high volumetric efficiency is disclosed. The rotary valve generally includes a cylindrical tube having an outer wall that defines intake and exhaust ports positioned to communicate with the engine cylinder as the valve rotates. A divider plate in the cylindrical tube defines an intake passageway from the first end of the valve to the intake port and defines an exhaust passageway from the exhaust port to the second end of the valve. A first generally helically-shaped blade is disposed in the intake passageway for accelerating a flow of intake fluid or fuel/air mixture through the intake passageway and into the cylinder. Similarly, a second generally helically-shaped blade is disposed in the exhaust passageway for facilitating the removal of exhaust gasses from the engine cylinder. The intake end of the rotary valve may also be provided with a plurality of forwardly curved fan blades positioned adjacent to openings in the cylindrical wall for facilitating the intake of the fuel/air mixture into the valve. In other embodiments, the rotary valve may be provided with a T-shaped member between the intake and exhaust ports for automatically adjusting the overlap between those ports. The intake port may also be provided with a spring-loaded T-shaped flap for increasing the size of the intake port as the rotational speed of the rotary valve increases. The rotary valve of this invention may also be used in combination with a turbine.

36 Claims, 6 Drawing Sheets

ROTARY VALVE FOR INTERNAL COMBUSTION ENGINE

BACKGROUND AND SUMMARY

This invention relates to internal combustion engines and, more particularly, to valve systems for supplying a fuel/air mixture from a carburetor or fuel injection system to the engine cylinders and for removing exhaust gasses from the cylinders to an exhaust manifold or exhaust pipes.

The most common type of valve train employs two or more reciprocal mushroom valves positioned over each of the engine cylinders and the valves are operated by a cam, push rods and rocker arms to open and close in a timed sequence. Typical mushroom valve engines employ two valves per cylinder, one valve for the intake mixture and the other valve for exhaust gasses. More recent engine designs employ four valves per cylinder, two intake valves and two exhaust valves, for increasing the volumetric efficiency of the engine. While providing four valves per cylinder head increases the volumetric efficiency of the engine and resultant engine power, such increased efficiency is achieved at the cost of engine complexity and expense, increased overall engine weight, and minimized effect in reducing pollutants output by the engine.

Attempts have been made to produce a more economical and efficient valve train for combustion engines and such attempts typically employ a rotary valve as exemplified in U.S. Pat. Nos. 5,205,251, 5,152,259, 4,949,685, and 4,036,184. While many of such rotary valve designs would be more economical and produce fewer pollutants than mushroom valve engines, such rotary valves have relatively limited port sizes and have been less than successful in providing sufficient volumetric efficiency to maintain acceptable levels of engine power. It is believed that most of such rotary valves are not even capable of providing the amount of engine power commonly associated with mushroom valve engines that employ two valves per cylinder.

An important aspect of this invention therefore lies in the discovery of a relatively uncomplicated and highly efficient rotary valve capable of providing high volumetric efficiency and high engine power of the level commonly associated with four valve per cylinder engines. Such results are accomplished by providing a cylindrical rotary valve having an intake passageway extending from a first end of the valve to an intake port and an exhaust passageway extending from an exhaust port to a second end of the valve. The intake passageway is provided with intake acceleration means for supercharging the fuel/air mixture into the cylinder and the exhaust passageway is provided with exhaust acceleration means for efficiently removing exhaust gasses from the cylinder. Such a construction is relatively uncomplex in design, is compact and lightweight and results in a valve train that produces high volumetric efficiency and high engine power.

In brief, the rotary valve of the present invention comprises a generally elongated cylindrical unitary body having a longitudinally extending axis of rotation and defining an intake port and an exhaust port. In multi-cylinder engines, a plurality of such unitary bodies are mounted transversely in an engine head above each of the cylinders so that the intake and exhaust ports of each of the unitary bodies periodically or cyclically communicate with the respective cylinders as the unitary body is rotated. The unitary body defines an intake passageway extending from a first end of the unitary body, which receives the fuel/air mixture from an intake manifold, to the intake port which communicates with the cylinder as the valve is rotated. The unitary body also defines an exhaust passageway extending from an exhaust port which communicates with the cylinder and a second end of the unitary body which communicates with an exhaust manifold or pipe. Intake acceleration means are disposed in the intake passageway for accelerating the flow of the fuel/air mixture through the intake passageway and supercharging that mixture through the intake port and into the cylinder head. Similarly, exhaust acceleration means are disposed in the exhaust passageway for accelerating the flow of exhaust gasses out of the cylinder and through the exhaust passageway to the exhaust manifold or pipe.

In a preferred embodiment, the intake acceleration means take the form of a first generally helically-shaped blade disposed in the intake passageway along the axis of rotation so that rotation of the valve and the helical blade draws the fuel/air mixture through the intake passageway and supercharges that mixture into the cylinder head. Similarly, the exhaust acceleration means take the form of a second generally helically-shaped blade disposed in the exhaust passageway along the axis of rotation to draw exhaust gasses from the cylinder head and facilitate their removal through the exhaust passageway and into the exhaust manifold or pipe. To further facilitate the intake of the fuel/air mixture, the intake acceleration means may also include a plurality of forwardly curved fan blades extending radially outward from the axis of rotation at the first end of the unitary body, each of the fan blades being positioned adjacent to one of a plurality of openings that communicate with the intake passageway. Optimally, the fan blades are mounted in an intake housing to draw the intake mixture from the intake manifold into the intake passageway.

In the preferred construction, the unitary body includes two main components: (1) a cylindrical tube having an outer wall that defines the intake and exhaust ports; and (2) dividing means for defining the intake and exhaust passageways within the cylindrical tube. The dividing means preferably take the form of a generally rectangular central divider plate aligned along the axis of rotation and having a pair of oppositely extending transverse flanges at each of its ends which divide the first half of the cylindrical tube into the intake passageway and the second half into the exhaust passageway. In such a construction, the helically-shaped blades of the intake and exhaust acceleration means extend oppositely outward from the opposite ends of the divider plate along the axis of rotation and into the respective intake and exhaust passageways.

In another embodiment, the rotary valve of this invention may be provided with automatic port overlap adjustment means for gradually or incrementally reducing the diameter of a portion of the outer wall between the intake and exhaust ports to allow gasses from the cylinder to simultaneously communicate with both the intake and exhaust ports as the rotational speed of the unitary body increases. Providing such a port overlap means results in a rotary valve in which little or no port overlap exists at idle or lower speeds but an increasing port overlap is provided at higher speeds to increase the volumetric efficiency of the rotary valve when it is required. Such a construction is greatly advantageous over prior art valve systems in which the amount of port overlap presented a compromise between a minimal overlap which is desirable at idle or lower speeds and a larger degree of overlap which is desirable at higher speeds. Such a compromise resulted in a valve system that did not provide optimal performance at the low and high ends of the operating speed spectrum. In contrast, the automatic port overlap means of this invention overcomes that deficiency by providing a variable overlap that self-adjusts for optimal operating conditions at both low and high speeds.

In a preferred form, the automatic port overlap means take the form of a T-shaped member having a stem portion which extends into an elongate edge of the divider plate and having an arcuate integral cross-member which forms the portion of the cylindrical wall between the intake and exhaust ports. The cross-member has a pair of opposite edges which each respectively define at least one edge of the intake and exhaust ports. Retraction means are provided for gradually retracting the stem of the T-shaped member into the divider plate as the rotational speed of the unitary body increases. This incrementally retracts the cross-member between the intake and exhaust ports which provides an increasing overlap at increasing speeds, providing greater volumetric efficiency for the engine as required.

In another embodiment, the intake port of the unitary body may be advantageously provided with expansion means for increasing the size of the intake port at high rotational speeds. In a preferred construction, the intake port expansion means take the form of a spring-loaded generally T-shaped flap having a stem extending into the cylindrical wall of the unitary body and having a head portion which defines an edge of the intake port. As the rotational speed of the unitary body increases, centrifugal force causes the spring-loaded T-shaped flap to retract into the cylindrical wall along with the head portion which increases the size of the intake port.

In another advantageous embodiment, turbine means are provided for further increasing the efficiency of the rotary valve of this invention. In such a construction, the first end of the rotary valve communicates with an intake housing and the second end of the rotary valve communicates with an exhaust housing. The turbine means include a turbine shaft in the head that extends parallel to the rotational axis of the rotary valve, a first turbine blade mounted on one end of the shaft in the intake housing, and a second turbine blade mounted at the other end of the shaft in the exhaust housing. In operation, the exhaust gasses flowing through the second end of the rotary valve rotate the second turbine blade which in turn rotates the first turbine blade. This creates a positive pressure in the pathway of the fuel/air mixture which supercharges that mixture into the intake passageway, thereby increasing the volumetric efficiency of the valve and the resultant engine power.

Other advantages, features, and objects of the invention will become apparent from the specification and drawings.

DETAILED DESCRIPTION OF PREFERRED EMBODIMENTS

Figure 1:
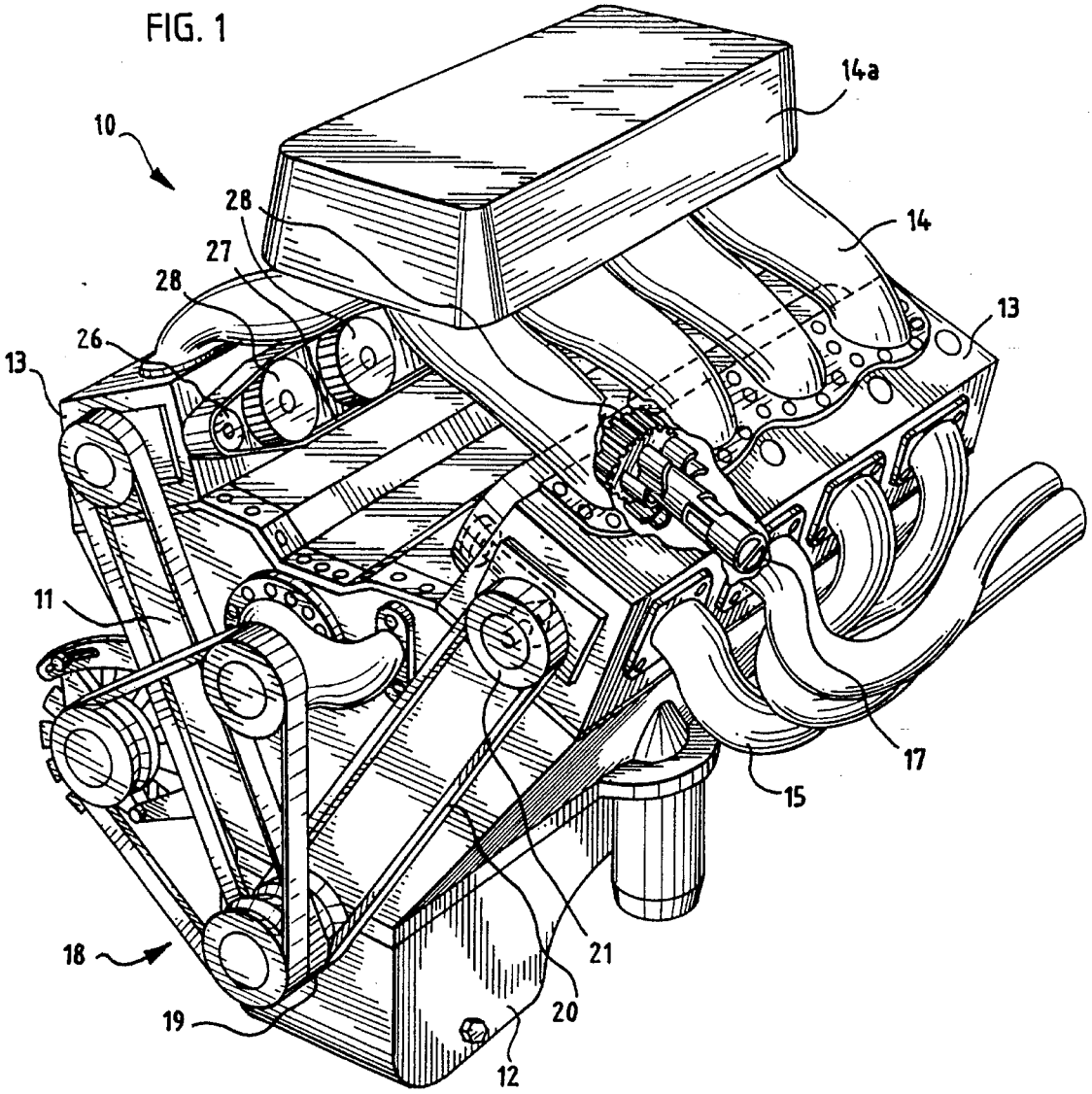
FIG. 1 is a partially cut-away perspective view of an internal combustion engine including the rotary valves of this invention.
Figure 2:
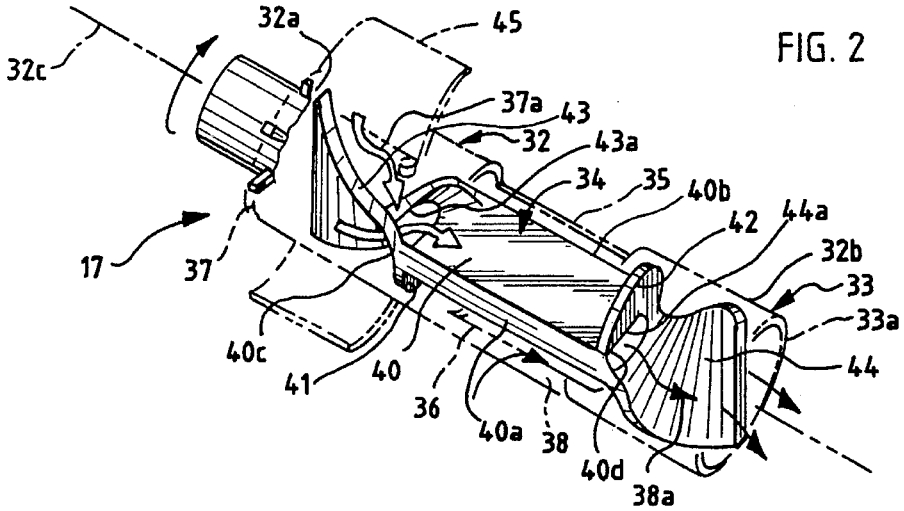
FIG. 2 is a partial, somewhat schematic, perspective view of a rotary valve embodying this invention.
Figure 3:
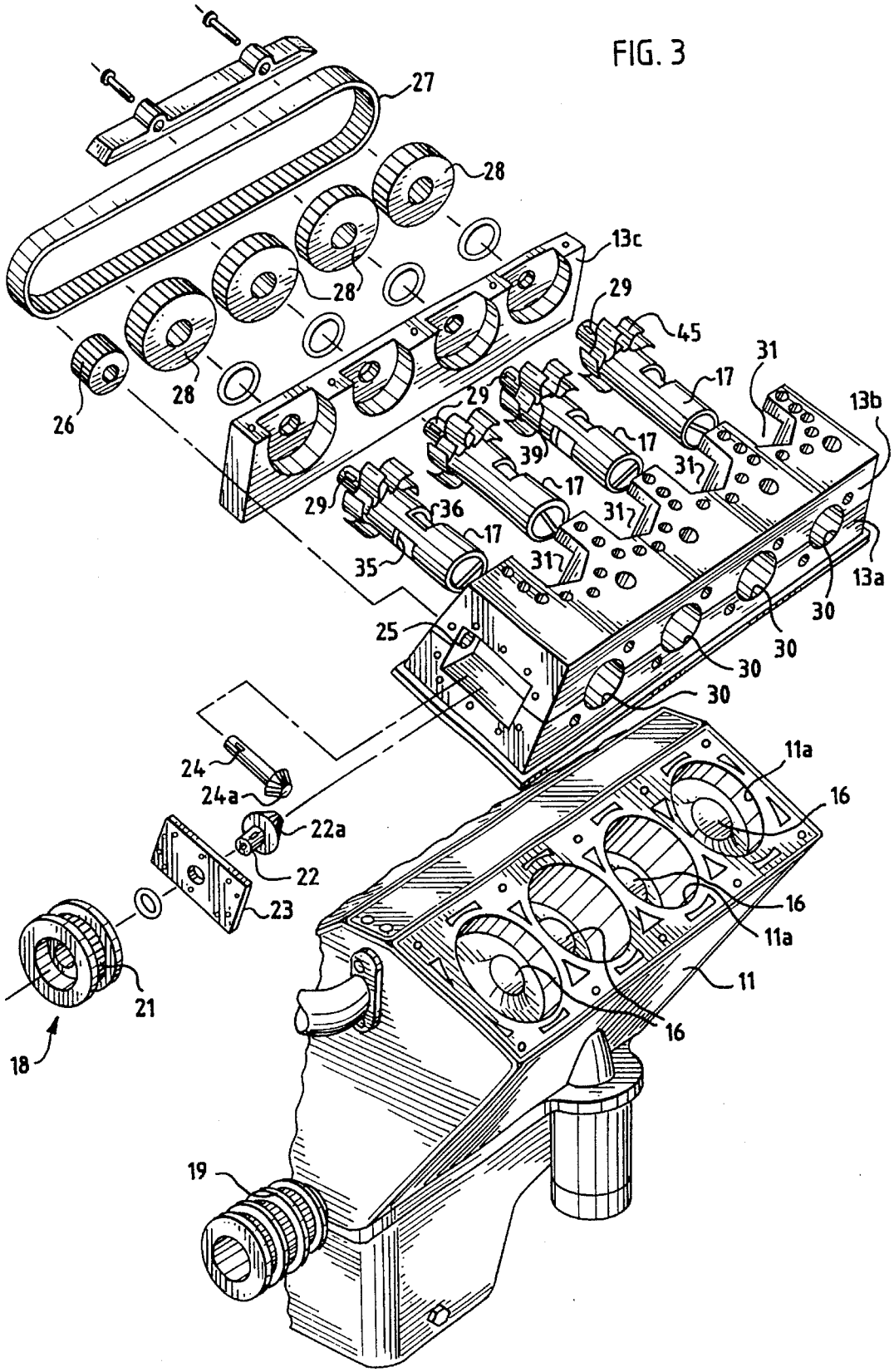
FIG. 3 is an exploded perspective view illustrating a plurality of rotary valves of this invention in relation to an internal combustion engine.

Referring to FIGS. 1–3, the numeral 10 generally designates an internal combustion engine having an engine block 11, an oil pan 12, heads 13, an intake manifold 14, and exhaust pipes 15. As most clearly seen in FIG. 3, engine block 11 defines a plurality of cylinders 11*a* each receiving a reciprocal piston 16. Except as herein described, many of the components of the internal combustion engine may be of conventional design and utility.

Each head 13 includes a plurality of rotary valves 17 which are each positioned above a cylinder 11*a* and piston 16. Each rotary valve 17 serves the function of receiving an intake fluid or fuel/air mixture from intake manifold 14 and conveying that fluid into the respective cylinder. The rotary valves also serve the function of receiving exhaust fluids or gasses from the cylinders and conveying that fluid to an exhaust manifold or exhaust pipes 15. Each of the rotary valves 17 is rotated in a timed sequence by a drive system generally designated at 18—see the lower left portion of FIG. 3.

In a preferred embodiment, drive system 18 is powered by pistons 16 that drive a crankshaft (not shown) which turns drive pulley 19. A belt 20 connects drive pulley 19 to a valve train pulley 21 which is mounted on one end of a shaft 22 having a beveled gear 22*a* which is received in head 13. A fastening plate 23 (see the lower left portion of FIG. 3) or other suitable means is used to mount shaft 22 and beveled gear 22*a* in position. A second shaft 24 is mounted in a hole or bearing 25 in head 13 and includes a beveled gear 24*a* which engages beveled gear 22*a*. Shaft 24 has a valve train gear 26 mounted on its other end which engages a timing belt 27—see the upper left portion of FIG. 3.

Timing belt 27 encircles valve train gear 26 and a plurality of valve gears 28 which are each connected to one of shafts 29 on rotary valves 17. The selection of gear ratios and belt lengths of the components of the valve train drive system may be varied to effectively time the rotation of rotary valves 17 as described in more detail herein below. Preferably, the rotational drive ratio of the crankshaft to the valves 17 is 2 to 1. It will be understood that other suitable drive means may be utilized to drive valves 17.

In the illustration given, head 13 includes a bottom 13*a*, a top 13*b* and an end plate 13*c*—see FIG. 3. Head bottom 13*a* and top 13*b* may be bolted together or connected by other suitable means to accommodate rotary valves 17 and define an exhaust housing 30 at one end of the head for connection to an exhaust manifold or exhaust pipes 15 as shown in FIG. 1. End plate 13*c* may be connected to the top and bottom of head 13 by bolts or other suitable means to define intake housings 31 around the other ends of the valves. Intake housings 31 are positioned to communicate with intake manifold 14 which may be bolted to the head. While exhaust housing 30 and intake housing 31 have been shown as being defined by head 13, it will be understood that the intake and exhaust housings may instead be attached to the head or positioned adjacent the head for respectively transmitting and receiving intake and exhaust fluids (see FIGS. 12–14).

Rotary Valve Detail

Figure 4:
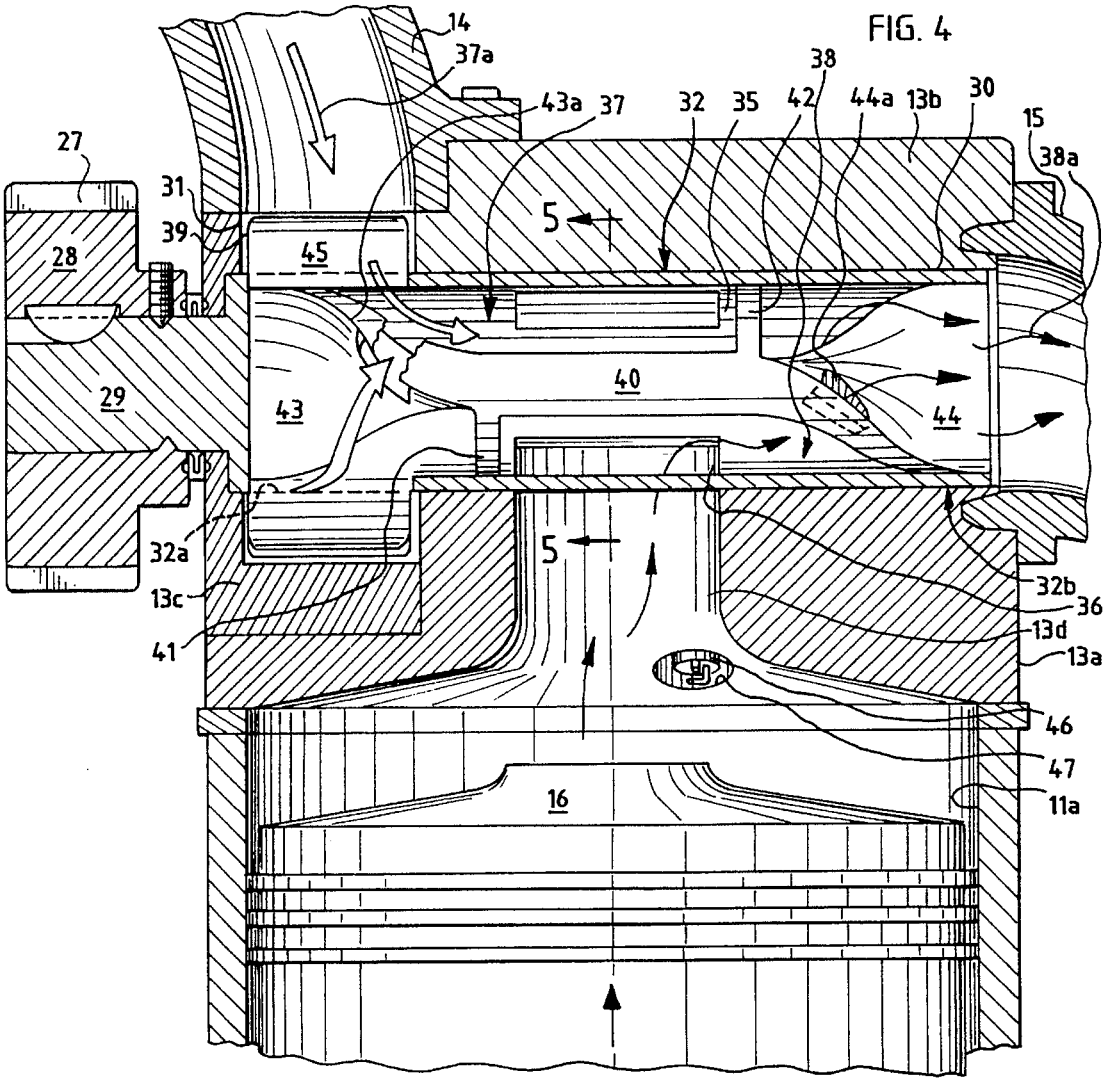
FIG. 4 is a somewhat schematic side view in partial cross-section illustrating the rotary valve of this invention in a cylinder head.

As best illustrated in FIGS. 2 and 4, rotary valve 17 includes a relatively elongated unitary body 32 having a first end 32*a*, a second end 32*b*, and a longitudinally extending axis of rotation 32*c*—see especially the left end of FIG. 2. First end 32*a* of the unitary body is disposed in intake housing 31 which communicates with intake manifold 14 and second end 32*b* of the unitary body is disposed in exhaust housing 30 which communicates with exhaust pipe 15. It will be noted that intake manifold 14 is connected to an intake system 14*a* (FIG. 1) which may include conventional carburetors or fuel injectors as desired to supply a fuel/air mixture to intake manifold 14.

Unitary body 32 is made up of two main components: an elongated hollow cylindrical tube 33 having an outer wall 33*a*; and a dividing means disposed in tube 33 and generally designated at 34. Outer wall 33*a* of tube 33 defines intake port 35 and exhaust port 36 which are both medially positioned on the unitary body. Dividing means 34 defines an intake passageway 37 extending between first end 32*a* of the unitary body and intake port 35 and defines an exhaust passageway 38 extending from exhaust port 36 to second end 32*b* of the unitary body 32—see particularly FIG. 2. Outer wall 33*a* also defines a plurality of openings 39 (see FIG. 3) at the first end 32*a* of the unitary body 32 which communicate with the intake passageway 37.

In a preferred embodiment, the dividing means 34 take the form of a generally rectangular central divider plate 40 (see the lower central portion of FIG. 2) having two elongate edges 40*a* and 40*b* extending parallel to axis 32*c* and having two shorter transverse edges 40*c* and 40*d*. A first flange 41 extends in a perpendicular direction integrally from transverse edge 40*c* and seals against outer wall 33*a*. A second flange 42 extends in an opposite perpendicular direction from transverse edge 40*d* and seals against outer wall 33*a*. One of the elongate edges of divider plate 40—edge 40*b* in the illustration—seals against outer wall 33*a* between the intake and exhaust ports to separate the intake and exhaust passageways.

Valve Operation

In operation, timing belt 27 (see FIG. 3) drives valve gears 28 which rotate valves 17. This results in intake ports 35 and exhaust ports 36 periodically communicating with the respective communication ports 13*d* in head 13 (see FIGS. 5–7) which are each positioned over one of cylinders 11*a* (FIG. 3). As the valves rotate, intake fluids 37*a* enter intake passageway 37 (see FIG. 4) through openings 39 and divider plate 40 and flange 42 only allow those intake fluids to communicate with intake port 35 for discharge into cylinder 11*a* when intake port 35 is aligned with port 13*d* (see FIG. 5). In a like manner, divider plate 40 and flange 41 direct exhaust fluids 38*a* from exhaust port 36 through exhaust passageway 38 so that the fluids are received by exhaust pipes 15.

Intake and Exhaust Acceleration Means

Intake acceleration means are disposed in intake passageway 37 for accelerating the flow of intake fluid 37*a* (see FIGS. 4 and 5) through the intake passageway from first end 32*a* of the unitary body to intake port 35. In a preferred embodiment, the intake acceleration means take the form of a generally helically-shaped blade 43 (see FIG. 2) that extends from transverse edge 40*c* of divider plate 40 into the intake passageway along the longitudinal axis of rotation of the unitary body.

When the unitary body 32 is rotated, the generally helical or spiral shape of blade 43 draws intake fluid 37*a* (see FIG. 5) into the intake passageway and compresses that fluid for exit through intake port 35 into cylinder 11*a*. Similarly, exhaust acceleration means are disposed in exhaust passageway 38 for accelerating the flow of exhaust fluid 38*a* through that passageway from exhaust port 36 to second end 32*b* of the unitary body which communicates with exhaust pipe 15.

In a preferred form, the exhaust acceleration means also includes a generally helically-shaped blade 44 (see FIG. 4) that extends from transverse edge 40*d* of divider plate 40 into the exhaust passageway along the longitudinal axis of rotation of the unitary body. When the unitary body is rotated, the helical or twisted shape of blade 44 acts to draw exhaust gasses 38*a* from the cylinder through exhaust port 36 and into and through the exhaust passageway, thereby facilitating removal of the exhaust gasses from the cylinder and valve.

In the illustrations given, it will be noted that blades 43 and 44 each have a flow-facilitating aperture 43*a* and 44*a* formed near their points of connection with the divider plate 40 (see FIG. 4). Providing such apertures in the helical blades allows for maximized fluid flow—as compared to using solid blades—through the respective passageways without impeding the accelerating effects of those blades for drawing fluids through the passageways.

Providing such a pair of helical blades 43 and 44 in the intake and exhaust passageways greatly facilitates intake of the fuel/air mixture and removal of the exhaust gasses which increases the volumetric efficiency of the valve and the resultant engine power. While blades 43 and 44 have been described as having a generally helically-shaped configuration, it will be understood that blades 43 and 44 may deviate from a strictly helical or spiral shape by including further twists or curvatures to facilitate the flow of gasses through the respective passageways. It will also be understood that, while it is believed optimal to have blades 43 and 44 extending in opposite directions from divider plate 40, it is contemplated that those blades may instead be connected to or a part of outer wall 33*a*.

In a preferred embodiment, the intake acceleration means further includes a plurality of forwardly curved fan blades 45 (see FIG. 3) which extend radially outward from the longitudinal axis of rotation at the first end of unitary body 32. Each of the fan blades 45 is positioned adjacent to one of openings 39 defined by outer wall 33*a*. Fan blades 45 act to draw intake fluid 37*a* into the intake passageway and further enhance the volumetric efficiency of the valve. Fan blades 45 also help to atomize the fuel. In the illustrations given in FIGS. 1–4, fan blades 45 are shown as being mounted on the exterior surface of wall 33*a*, however, fan blades 45 may instead be mounted internally to wall 33*a* to create a vacuum on the interior of openings 39 and such an embodiment is further discussed in connection with FIG. 12.

Operation in FIGS. 4–7

Figure 5:
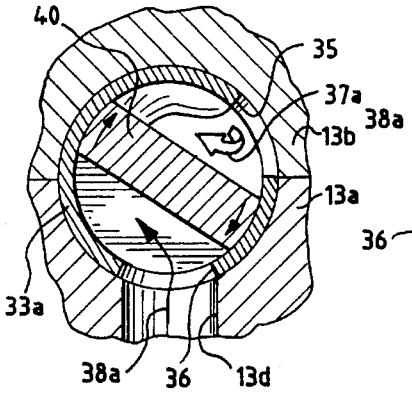
FIG. 5 is a cross-sectional view taken along line 5—5 of FIG. 4 and illustrating the rotary valve in a first position in which it draws exhaust gasses out of the cylinder.

The operation of the inventive rotary valves of this invention is best illustrated by reference to FIGS. 4–7. Referring to FIG. 4, piston 16 is shown at almost the top dead center position. This results—as seen in FIG. 5 also—in exhaust fluids 38*a* exiting the cylinder and flowing through port 13*d* of head 13. Once exhaust fluids 38*b* enter exhaust passageway 38, the exhaust acceleration means or blade 44 acts to quickly evacuate those fluids from the cylinder and the valve. While the exhaust fluids are being removed, intake fluids 37*a* are drawn into intake passageway 37 by the intake acceleration means and compressed in that passageway (FIGS. 5 and 6) until intake port 35 is brought into communication with port 13*d* as shown in FIG. 7, at which point the intake fluids flow into the cylinder. In a conventional manner, the spark plug 46 seated in bore 47 then fires to cause the piston 16 to take its downward stroke to a bottom position (not shown).

As shown, intake port 35 and exhaust port 36 preferably have the same sized opening which matches the opening size of port 13*d*. It will be further noted that unitary body 32 may be integrally cast or assembled as two main components, first, the elongate cylindrical tube 33 and second, the dividing means 34. Particularly suitable materials for constructing unitary body 32 include cast iron or aluminum with a ceramic coating on the inside of the tube. The outside of the tube may also be provided with Micro Channel Chromium Molybdenum plating and a PTFE (TEFLON) coating may be sprayed on the plating.

Figure 6:
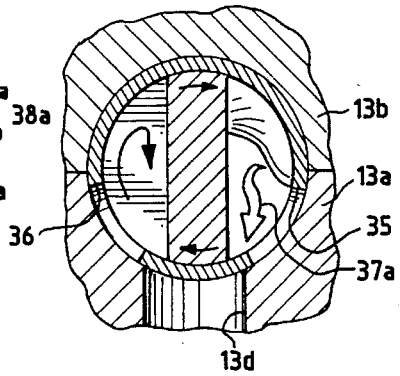
FIG. 6 is a cross-sectional view illustrating the rotary valve of FIG. 5 in a second position.
Figure 7:
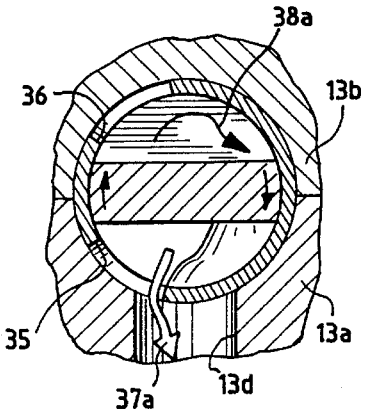
FIG. 7 is a cross-sectional view illustrating the rotary valve of FIG. 6 in a third position.

FIG. 6 illustrates the rotary valve in a position in which neither of the intake or exhaust ports communicate with head port 13*d;* however, the intake and exhaust ports may be positioned in wall 33*a* so that some overlap occurs between the ports depending upon the particular engine design. It will be further understood that the positioning and size of the intake and exhaust ports may be varied as exemplified in the further inventive embodiments described below.

Figure 8:
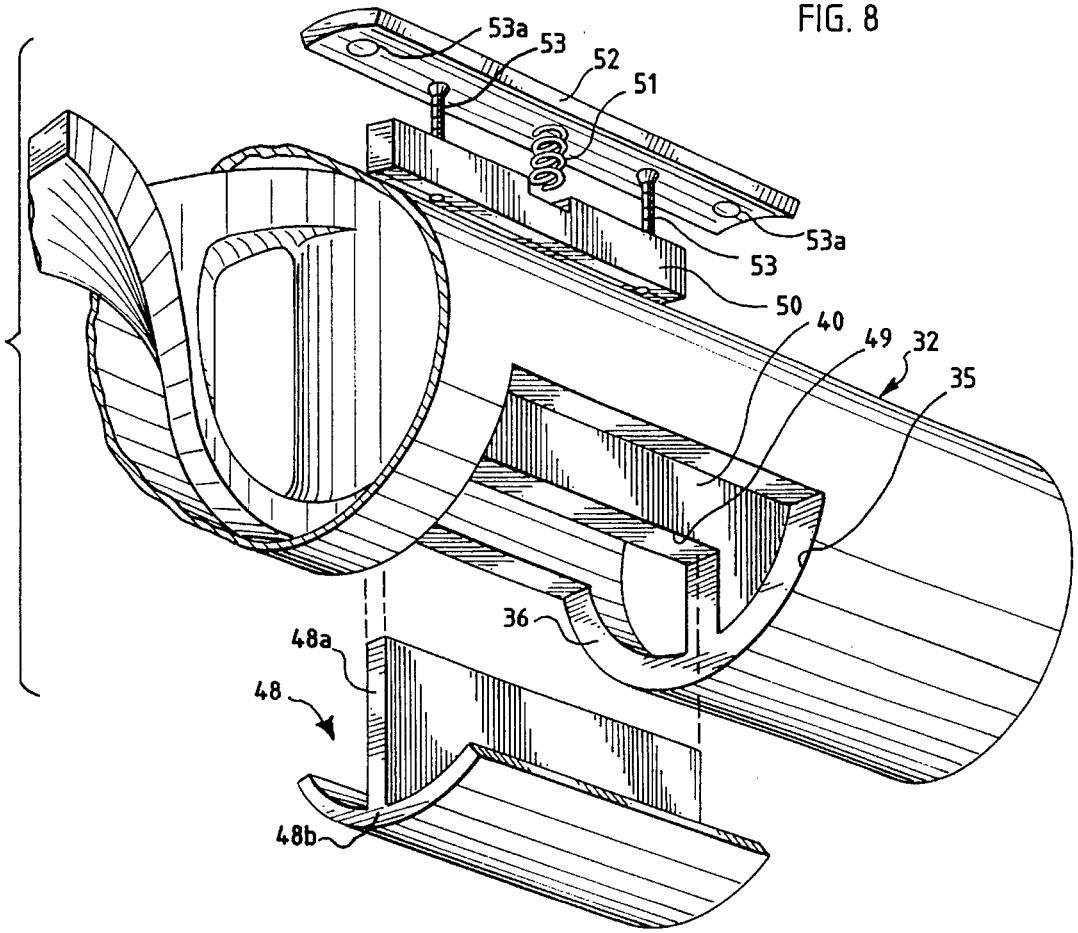
FIG. 8 is an exploded, somewhat schematic, perspective view illustrating the automatic port overlap adjustment means of this invention.
Figure 9:
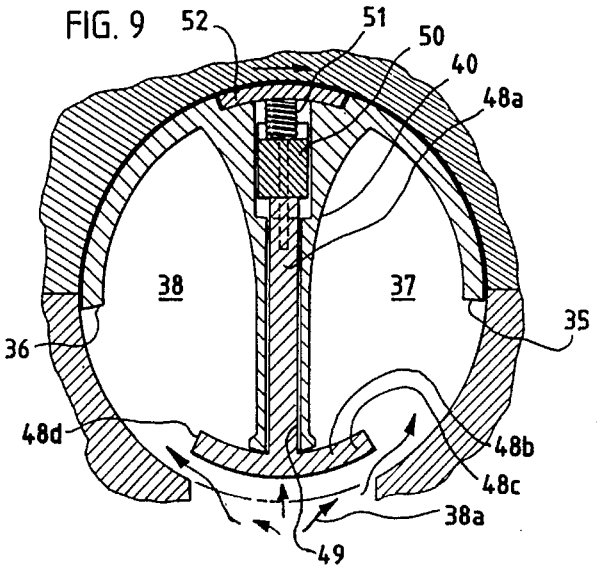
FIG. 9 is a cross-sectional view of the automatic port overlap adjustment means of FIG. 8.
Figure 9A:
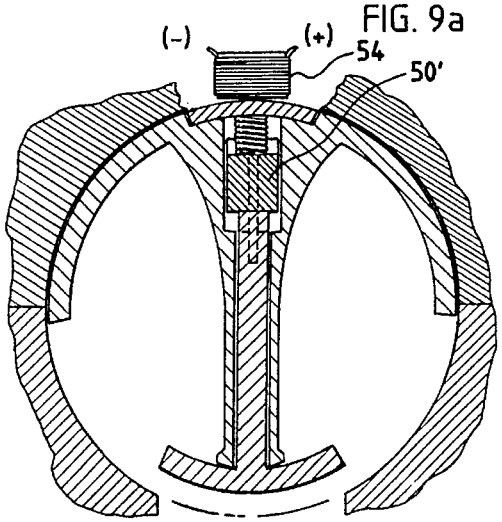
FIG. 9*a* is a cross-sectional view of the automatic port overlap adjustment means of FIGS. 8 and 9 illustrating an alternate embodiment of the retraction means.

Embodiments of FIGS. 8, 9, and 9*a*

In another embodiment illustrated in FIGS. 8 and 9, automatic port overlap adjustment means may be provided in the unitary body for automatically adjusting the amount of overlap that occurs between the intake and exhaust ports 35 and 36 and head port 13*d*. Such automatic port overlap means may take the form of a T-shaped member 48 having a stem 48*a* and an integral arcuate cross-member 48*b* that forms a portion of outer wall 33*a* between the intake and exhaust ports. Cross-member 48*b* includes two opposite edge portions 48*c* and 48*d* which each define an edge of the intake and exhaust ports 35 and 36. As shown, divider plate 40 in this embodiment is partially cut away and includes a recess 49 for receiving stem 48*a* of the T-shaped member.

Retraction Means

Retraction means are provided for gradually retracting stem 48*a* into divider plate 40 as the engine load increases and the exhaust gasses create higher pressures. Such retraction means may advantageously take the form of a weight member 50 connected to stem 48*a* which rests against spring 51 which is sealed into the unitary body by a cover plate 52. A pair of screws 53 or other suitable fastening means may be used to connect weight member 50 to stem 48*a* and a second set of screws or other fastening means (not shown) may be inserted through apertures 53*a* in cover plate 52 to seal cover plate 52 in the unitary body and hold spring 51 against weight member 50.

In such a construction, when the engine load increases, the exhaust gasses create higher pressures against cross-member 48*b* and stem 48*a* incrementaly or gradually retracts into recess 49 creating a port overlap. Such retraction causes arcuate cross-member 48*b* to pull away from the outer circumference of the cylindrical tube and allows gasses from the cylinder to simultaneously communicate with intake and exhaust ports 35 and 36. Preferably, weight member 50 and spring 51 are designed to gradually allow the port overlap to occur as the exhaust gas pressure increase. When the engine load decreases or is at normal operating pressures, no overlap occurs and T-shaped member 48 stays in its normal position. Such a construction provides for increased overlap at high rotational speeds improves the volumetric efficiency while providing for little or no overlap at low speeds where port overlap is not desirable. Such a configuration allows the rotary valve to provide optimal performance at both idle and high speeds.

In an alternate construction illustrated in FIG. 9*a*, the retraction means may take the form of a solenoid 50' in combination with a magnet 54. A control means (not shown) is provided for increasing the power of magnet 54 as the rotational speed of the rotary valve increases which gradually or incrementally retracts solenoid 50', creating a port overlap The control means can be timed or programmed so that retraction of T-shaped member 48 is automatic.

Figure 10:
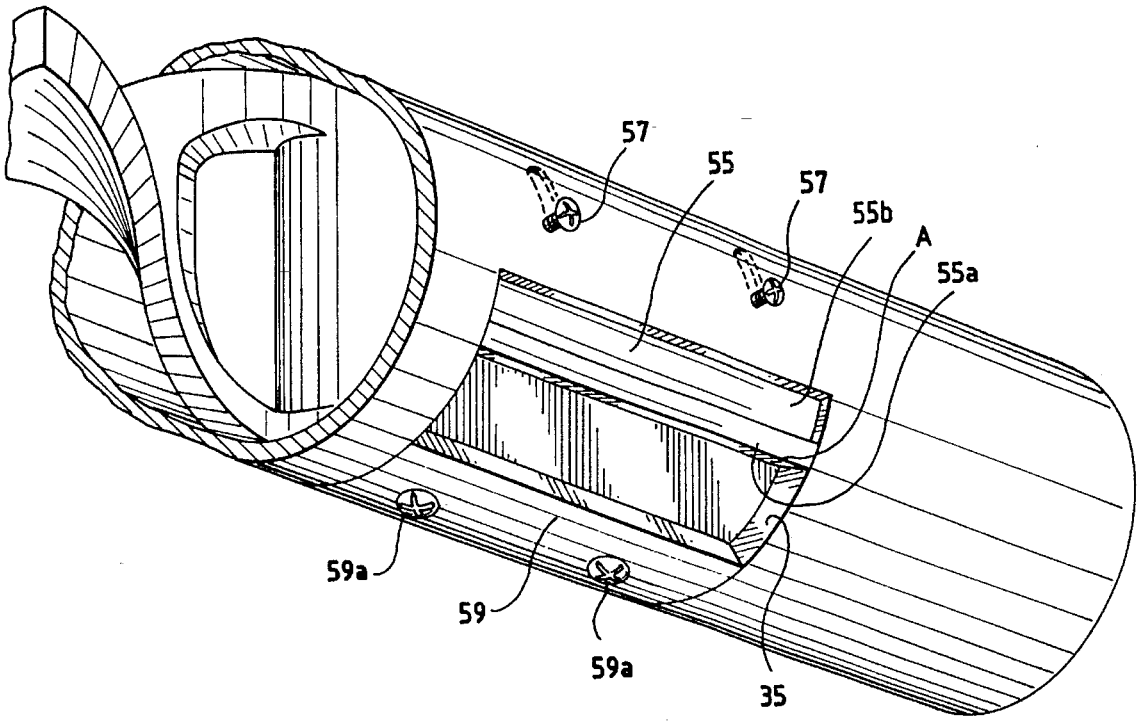
FIG. 10 is a fragmentary perspective view illustrating the intake port expansion means of this invention.
Figure 11:
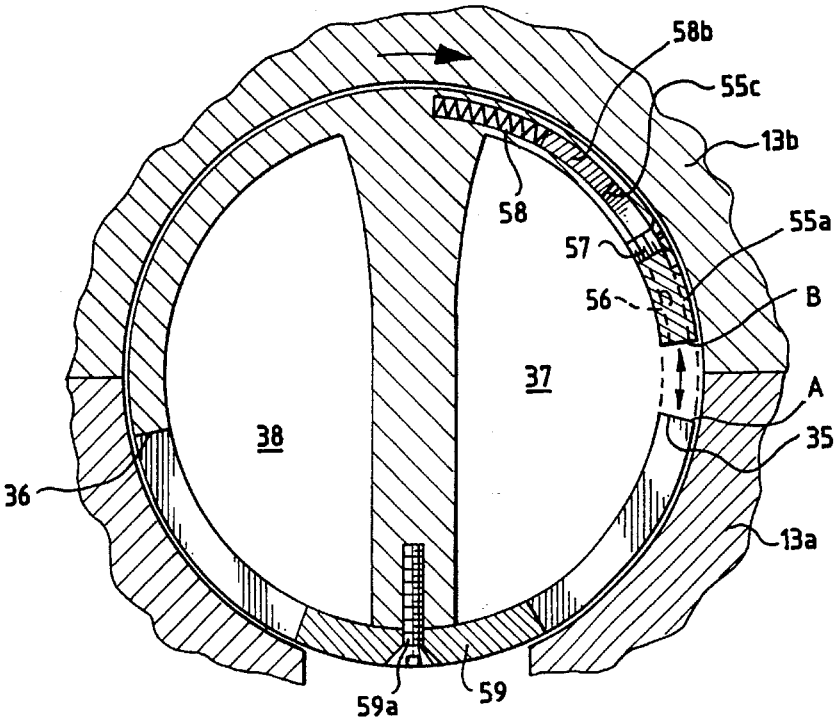
FIG. 11 is a cross-sectional view illustrating the intake port expansion means of FIG. 10.

Embodiment of FIGS. 10 and 11

In another embodiment illustrated in FIGS. 10 and 11, expansion means may be provided for increasing the size of intake port 35 at high rotational speeds to increase the volumetric efficiency of the valve. In a preferred embodiment, the intake port expansion means includes a spring-loaded generally T-shaped arcuate flap 55. Flap 55 is best positioned at the trailing edge of intake port 35—see for example the designation 35*a* in FIG. 7. This increases the port size when the rotational speed of the valve increases. In such a construction, flap 55 includes an arcuate stem 55*a* that extends into a recess 56 in outer wall 33*a* of the unitary body. A head portion 55*b* is mounted on or integral with stem 55*a* and defines an edge of intake port 35. Stem 55*a* includes a pair of slots 55*c* which receive screws 57 and limit the movement of flap 55. A spring 58 is provided in the bottom of recess 56 for biasing flap 55 to its outermost position A so that intake port 35 has its normal size, approximately equaling the size of exhaust port 36 and head port 13*d*, during low speed operation. However, as the rotational speed of the rotary valve increases, centrifugal force acts against the mass of head portion 55*b* which gradually compresses spring 58 to increase the size of intake port 35 to a fully retracted position B at high speeds. At such speeds, the rotational mass of the head portion maintains the flap in its fully retracted position.

Such a gradual increase in the size of intake port 35 provides for increased volumetric efficiency when the engine is operated at high speeds which results in increased engine power when required. In such a construction, an arcuate member 59 may be connected to divider plate 40 by screws 59*a* to form the portion of the cylindrical wall between the intake and exhaust ports. Making member 59 removable in this embodiment is advantageous as it allows flap 55 to be easily inserted into recess 56 when the valve is assembled. It will be understood that the intake port expansion means may be used in combination with the automatic port overlap adjustment means; however, rotary valve 17 may be provided with neither of these improvements, or just one of these improvements, or both, depending upon the desired engine application.

Figure 12:
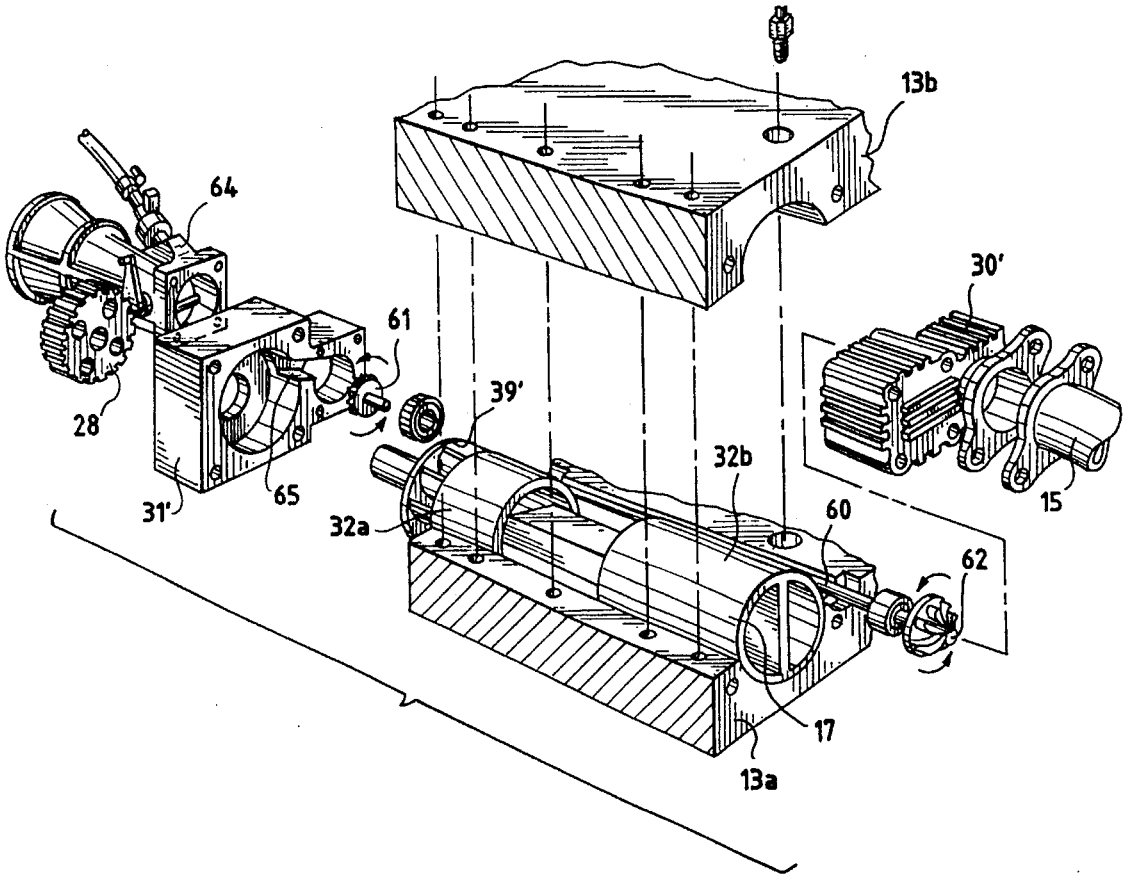
FIG. 12 is an exploded perspective view of the rotary valve of this invention used in combination with a turbine means.
Figure 14:
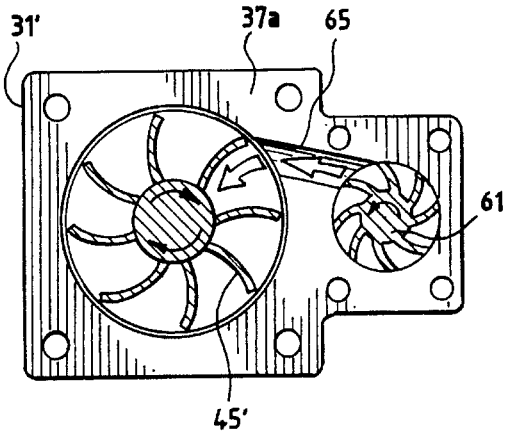
FIG. 14 is a cross-sectional view of the intake housing which surrounds the intake turbine of the turbine means.
Figure 13:
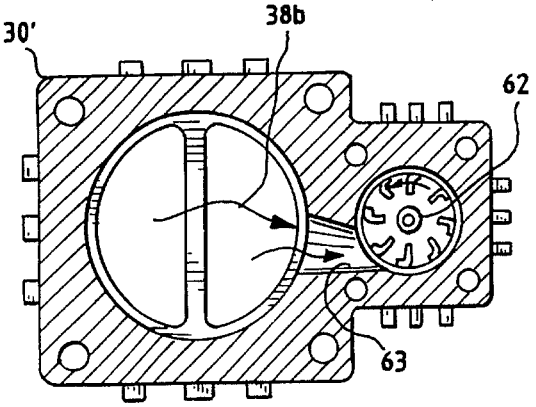
FIG. 13 is a cross-sectional view illustrating the exhaust housing which surrounds the exhaust turbine of the turbine means.

Embodiment of FIGS. 12–14

In another embodiment of the present invention illustrated in FIGS. 12–14, rotary valve 17 is used in combination with turbine means for further increasing the volumetric efficiency of the valve and engine. In a preferred embodiment, the turbine means take the form of a turbine shaft 60 mounted in head 13 and being positioned parallel and adjacent to rotary valve 17. A first turbine blade 61 is mounted on one end of shaft 60 and is positioned to be received in an intake housing 31'. A second turbine blade 62 is positioned at the other end of shaft 60 and is positioned to be received in an exhaust housing 30'—see FIG. 13. In such a construction, it will be noted that intake housing 31' and exhaust housing 30' are formed as separate units that connect to head 13 and are positioned to communicate respectively with first end 32*a* and second end 32*b* of the unitary body. It will also be noted that fan blades 45' may be positioned internally of outer wall 33*a* as most clearly seen in FIG. 14. Each of the fan blades 45' is positioned adjacent an opening 39' as earlier described for facilitating the intake of intake fluids 37*a* into the intake passageway.

In operation, exhaust fluids 38*a* exit second end 32*b* of the unitary body and flow through a passageway 63 in exhaust housing 30' so that the exhaust fluids 38*a* engage second turbine blade 62 and cause rotation of that blade. Rotation of second turbine blade 62 causes rotation of shaft 60 and also first turbine blade 61. First turbine blade 61 is positioned to receive a fuel/air mixture from fuel injector 64 or other suitable intake means and propel that intake fluid through passageway 65 where it enters openings 39'. Blades 45' further draw the intake fluid into the valve where it is communicated to the intake port. Such a construction provides for a highly efficient and effective rotary valve and turbine combination that produces high volumetric efficiency for the engine and high resultant engine power.

While in the foregoing, embodiments of the invention have been disclosed in considerable detail for purposes of illustration, it will be understood that any of these details may be varied without departing from the spirit and scope of the invention.

I claim:

1. A rotary valve comprising:

a generally elongated cylindrical unitary body having first and second ends and a longitudinally extending axis of rotation and defining an intake port and an exhaust port;

said unitary body providing an intake passageway extending between said first end of said unitary body and said intake port and an exhaust passageway extending from said exhaust port to said second end of said unitary body;

intake acceleration means disposed in said intake passageway for accelerating a flow of intake fluid through said intake passageway from said first end to said intake port, said intake acceleration means comprising a generally helically-shaped blade which is disposed in said intake passageway and extends along and is helically twisted about said axis of rotation of said body; and exhaust acceleration means disposed in said exhaust passageway for accelerating a flow of exhaust fluid through said exhaust passageway from said exhaust port to said second end of said unitary body, said exhaust acceleration means comprising a generally helically-shaped blade which is disposed in said exhaust passageway and extends along and is helically twisted about said axis of rotation of said body.

2. The rotary valve of claim 1 in which said intake acceleration means further comprises a plurality of forwardly curved fan blades which extend radially outward from said axis of rotation at said first end of said unitary body, each of said fan blades being positioned adjacent to one of a plurality of openings in said unitary body which communicate with said intake passageway.

3. The rotary valve of claim 1 in which said unitary body includes a hollow cylindrical tube having an outer wall which defines said intake and exhaust ports and a dividing means for defining said intake and exhaust passageways within said cylindrical tube.

4. A rotary valve comprising:

a generally elongated cylindrical unitary body having first and second ends and a longitudinally extending axis of rotation and defining an intake port and an exhaust port;

said unitary body providing an intake passageway extending between said first end of said unitary body and said intake port and an exhaust passageway extending from said exhaust port to said second end of said unitary body;

intake acceleration means disposed in said intake passageway for accelerating a flow of intake fluid through said intake passageway from said first end to said intake port;

exhaust acceleration means disposed in said exhaust passageway for accelerating a flow of exhaust fluid through said exhaust passageway from said exhaust port to said second end of said unitary body;

said unitary body including a hollow cylindrical tube having an outer wall which defines said intake and exhaust ports and a dividing means for defining said intake and exhaust passageways within said cylindrical tube, said dividing means including a generally rectangular central divider plate aligned along said axis of rotation and having two elongate edges parallel to said axis of rotation and two transverse edges; said intake and exhaust ports being positioned on opposite sides of one of said elongate edges of said divider plate; said dividing means also including a first flange extending in a perpendicular direction from one of said transverse edges of said divider plate and a second flange extending in an opposite perpendicular direction from the other of said transverse edges of said divider plate.

5. The rotary valve of claim 4 in which said intake acceleration means comprises a generally helically-shaped blade extending from one of said transverse edges of said divider plate along said axis of rotation.

6. The rotary valve of claim 5 in which said outer wall of said tube defines a plurality of openings at said first end of said unitary body and said intake acceleration means further comprises a plurality of forwardly curved fan blades which extend radially outward from said unitary body; each of said fan blades being positioned adjacent to one of said plurality of openings which communicate with said intake passageway.

7. The rotary valve of claim 5 in which said exhaust acceleration means comprises a generally helically-shaped blade extending from the other of said transverse edges of said divider plate along said axis of rotation.

8. The rotary valve of claim 7 in which said helically-shaped blades of said intake and exhaust acceleration means each include a flow-facilitating aperture.

9. A rotary valve comprising:

a generally elongated cylindrical unitary body having first and second ends and a longitudinally extending axis of rotation and defining an intake port and an exhaust port;

said unitary body providing an intake passageway extending between said first end of said unitary body and said intake port and an exhaust passageway extending from said exhaust port to said second end of said unitary body;

intake acceleration means disposed in said intake passageway for accelerating a flow of intake fluid through said intake passageway from said first end to said intake port; and exhaust acceleration means disposed in said exhaust passageway for acclerating a flow of exhaust fluid through said exhaust passageway from said exhaust port to said second end of said unitary body;

said unitary body including a hollow cylindrical tube having an outer wall which defines said intake and exhaust ports and a dividing means for defining said intake and exhaust passageways within said cylindrical tube, said dividing means including a divider plate having a pair of elongate edges with one of said elongate edges being positioned between said intake and exhaust ports;

10. The rotary valve of claim 9 in which said port overlap adjustment means comprises a T-shaped member having a stem portion which extends into one of said elongate edges of said divider plate and having an arcuate integral cross-member which forms said portion of said cylindrical wall between said intake and exhaust ports, said cross-member having a pair of opposite edges which each respectively define at least one edge of said intake and exhaust ports.

11. The rotary valve of claim 10 in which said port overlap adjustment means further includes retraction means for gradually retracting said stem of said T-shaped member into said divider plate as a rotational speed of said unitary body increases.

12. A rotary valve comprising:

a generally elongated cylindrical unitary body having first and second ends and a longitudinally extending axis of rotation and defining an intake port and an exhaust port;

said unitary port providing an intake passageway extending between said first end of said unitary body and said intake port and an exhaust passageway extending from said exhaust port to said second end of said unitary body;

intake acceleration means disposed in said intake passageway for accelerating a flow of intake fluid through said intake passageway from said first end to said intake port; and exhaust acceleration means disposed in said exhaust passageway for accelerating a flow of exhaust fluid through said exhaust passageway from said exhaust port to said second end of said unitary body;

said unitary body including a hollow cylindrical tube having an outer wall which defines said intake and exhaust ports and a dividing means for defining said intake and exhaust passageways within said cylindrical tube, said intake port having a predetermined port size and including expansion means for gradually increasing said port size as a rotational speed of said unitary body increases.

13. The rotary valve of claim 12 in which said intake port expansion means comprises a spring-loaded generally T-shaped flap having a stem extending into said outer wall of said unitary body and having a head portion defining an edge of said intake port.

14. In combination with an internal combustion engine of the type having an engine block defining at least one cylinder and having a reciprocal piston mounted therein, said engine also having a removable head connected to said engine block and defining a communication port over said at least one cylinder, wherein the improvement comprises:

a rotary valve rotatably mounted in said head and comprising a generally elongated cylindrical unitary body having a longitudinally extending axis of rotation and defining an intake port and an exhaust port positioned to periodically communicate with said communication port of said head when said unitary body is rotated;

said unitary body defining an intake passageway extending between a first end of said unitary body and said intake port and an exhaust passageway extending from said exhaust port to a second end of said unitary body;

intake acceleration means disposed in said intake passageway for accelerating a flow of intake fluid through said intake passageway from said first end to said intake port;

exhaust acceleration means disposed in said exhaust passageway for accelerating a flow of exhaust fluid through said exhaust passageway from said exhaust port to said second end of said unitary body;

said intake acceleration means comprising a first generally helically-shaped blade which is disposed in said intake passageway and said exhaust acceleration means comprising a second generally helically-shaped blade disposed in said exhaust passageway, said first and second blades extending along and being helically twisted about said axis of rotation of said body.

15. The rotary valve of claim 14 in which said intake acceleration means further comprises a plurality of forwardly curved fan blades which extend radially outward from said axis of rotation at said first end of said unitary body, each of said fan blades being positioned adjacent to one of a plurality of openings in said unitary body which communicate with said intake passageway.

16. The rotary valve of claim 14 in which said unitary body includes a hollow cylindrical tube having an outer wall defining said intake and exhaust ports and a dividing means for defining said intake and exhaust passageways within said cylindrical tube.

17. In combination with an internal combustion engine of the type having an engine block defining at least one cylinder and having a reciprocal piston mounted therein, said engine also having a removable head connected to said engine block and defining a communication port over said at least one cylinder, wherein the improvement comprises:

a rotary valve rotatably mounted in said head and comprising a generally elongated cylindrical unitary body having a longitudinally extending axis of rotation and defining an intake port and an exhaust port positioned to periodically communicate with said communication port of said head when said unitary body is rotated;

said unitary body defining an intake passageway extending between a first end of said unitary body and said intake port and an exhaust passageway extending from said exhaust port to a second end of said unitary body, said unitary body including a hollow cylindrical tube having an outer wall defining said intake and exhaust ports and a dividing means for defining said intake and exhaust passageways within said cylindrical tube;

intake acceleration means disposed in said intake passageway for accelerating a flow of intake fluid through said intake passageway from said first end to said intake port;

exhaust acceleration means disposed in said exhaust passageway for accelerating a flow of exhaust fluid through said exhaust passageway from said exhaust port to said second end of said unitary body;

said dividing means including a generally rectangular central divider plate aligned along said axis of rotation and having two elongate edges parallel to said axis of rotation and two transverse edges; said intake and exhaust ports being positioned on opposite sides of one of said elongate edges of said divider plate; said dividing means also including a first flange extending in a perpendicular direction from one of said transverse edges of said divider plate and a second flange extending in an opposite perpendicular direction from the other of said transverse edges of said divider plate; said intake acceleration means comprising a first generally helically-shaped blade extending from one of said transverse edges of said divider plate along said axis of rotation; said exhaust acceleration means comprising a second generally helically-shaped blade extending from the other of said transverse edges of said divider plate along said axis of rotation.

18. The rotary valve of claim 17 in which said outer wall of said tube defines a plurality of openings at said first end of said unitary body and said intake acceleration means further comprises a plurality of forwardly curved fan blades which extend radially outward from said axis of rotation, each of said fan blades being positioned adjacent to one of said plurality of openings which communicate with said intake passageway.

19. The rotary valve of claim 17 in which said first and second helically-shaped blades each include a flow-facilitating aperture.

20. The rotary valve of claim 17 in which port overlap adjustment means are provided for gradually reducing the diameter of a portion of said cylindrical wall between said intake and exhaust ports to create an overlap between said intake and exhaust ports as a rotational speed of said unitary body increases.

21. The rotary valve of claim 20 in which said port overlap adjustment means comprises a T-shaped member having a stem portion which extends into one of said elongate edges of said divider plate and having an arcuate integral cross-member which forms said portion of said cylindrical wall between said intake and exhaust ports, said cross-member having a pair of opposite edges which each respectively define at least one edge of said intake and exhaust ports.

22. The rotary valve of claim 21 in which said port overlap adjustment means further includes retraction means for gradually retracting said stem of said T-shaped member into said divider plate as said unitary body is rotated at increasing rotational speeds.

23. The rotary valve of claim 14 in which said engine further includes an intake housing positioned to communicate with said first end of said unitary body and an exhaust housing positioned to communicate with said second end of said unitary body, said intake and exhaust housings including turbine means for increasing a rate of flow of said intake fluids into said intake passageway.

24. In combination with an internal combustion engine of the type having an engine block defining at least one cylindrical and having a reciprocal piston mounted therein, said engine also having a removable head connected to said engine block and defining a communication port over said at least one cylinder, wherein the improvement comprises:

a rotary valve rotatably mounted in said head and comprising a generally elongated cylindrical unitary body having a longitudinally extending axis of rotation and defining an intake port and an exhaust port positioned to periodically communicate with said communication port of said head when said unitary body is rotated;

said intake port having a port size and including expansion means for gradually increasing said port size as a rotational speed of said unitary body increases;

said unitary body defining an intake passageway extending between a first end of said unitary body and said intake port and an exhaust passageway extending from said exhaust port to a second end of said unitary body;

intake acceleration means disposed in said intake passageway for accelerating a flow of intake fluid through said intake passageway from said first end to said intake port; and exhaust acceleration means disposed in said exhaust passageway for accelerating a flow of exhaust fluid through said exhaust passageway from said exhaust port to said second end of said unitary body.

25. The rotary valve of claim 24 in which said intake port expansion means comprises a spring-loaded generally T-shaped flap having a stem extending into said outer wall of said unitary body and having a head portion defining an edge of said intake port.

26. In combination with an internal combustion engine of the type having an engine block defining at least one cylinder and having a reciprocal piston mounted therein, said engine also having a removable head connected to said engine block and defining a communication port over said at least one cylinder, wherein the improvement comprises:

a rotary valve rotatably mounted in said head and comprising a generally elongated cylindrical unitary body having a longitudinally extending axis of rotation and defining an intake port and an exhaust port positioned to periodically communicate with said communication port of said head when said unitary body is rotated;

said unitary body defining an intake passageway extending between a first end of said unitary body and said intake port and an exhaust passageway extending from said exhaust port to a second end of said unitary body;

intake acceleration means disposed in said intake passageway for accelerating a flow of intake fluid through said intake passageway from said first end to said intake port;

exhaust acceleration means disposed in said exhaust passageway for accelerating a flow of exhaust fluid through said exhaust passageway from said exhaust port to said second end of said unitary body;

said engine further including an intake housing positioned to communicate with said first end of said unitary body and an exhaust housing positioned to communicate with said second end of said unitary body, said intake and exhaust housings including turbine means for increasing a rate of flow of said intake fluids into said intake passageway, said turbine means comprising a turbine shaft extending parallel to said axis of rotation through said head, a first turbine blade positioned in said intake housing and mounted on one end of said turbine shaft, and a second turbine blade positioned in said exhaust housing and mounted on the other end of said turbine shaft; said second turbine blade being positioned to receive said exhaust fluids from said second end of said unitary body which causes rotation of said second turbine, said turbine shaft, and said first turbine which propels said intake fluids into said intake passageway.

27. A rotary valve comprising:

a generally elongated cylindrical unitary body having first and second ends and a longitudinally extending axis of rotation and defining an intake port and an exhaust port;

said unitary body providing an intake passageway extending between said first end of said unitary body and said intake port and an exhaust passageway extending from said exhaust port to said second end of said unitary body;

said unitary body including a hollow cylindrical tube having an outer wall which defines said intake and exhaust ports and a dividing means for defining said intake and exhaust passageways within said cylindrical tube, said dividing means including a generally rectangular central divider plate aligned along said axis of rotation and having two elongate edges parallel to said axis of rotation and two transverse edges; said intake and exhaust ports being positioned on opposite sides of one of said elongate edges of said divider plate; said dividing means also including a first flange extending in a generally perpendicular direction from one of said transverse edges of said divider plate and a second flange extending in a generally opposite perpendicular direction from the other of said transverse edges of said divider plate.

28. A rotary valve comprising:

a generally elongated cylindrical unitary body having first and second ends and a longitudinally extending axis of rotation and defining an intake port and an exhaust port;

said unitary body providing an intake passageway extending between said first end of said unitary body and said intake port and an exhaust passageway extending from said exhaust port to said second end of said unitary body;

said unitary body including a hollow cylindrical tube having an outer wall which defines said intake and exhaust ports and a dividing means for defining said intake and exhaust passageways within said cylindrical tube, and port overlap adjustment means provided in said tube for gradually reducing the diameter of a portion of said cylindrical wall between said intake and exhaust ports to create an overlap between said intake and exhaust ports as a rotational speed of said unitary body increases.

29. The rotary valve of claim 28 in which said dividing means comprises a divider plate having elongate edges and said port overlap adjustment means comprises a T-shaped member having a stem portion which extends into one of said elongate edges of said divider plate and having an arcuate integral cross-member which forms said portion of said cylindrical wall between said intake and exhaust ports, said cross-member having a pair of opposite edges which each respectively define at least one edge of said intake and exhaust ports.

30. The rotary valve of claims 29 in which said port overlap adjustment means further includes retraction means for gradually retracting said stem of said T-shaped member into said divider plate as a rotational speed of said unitary body increases.

31. A rotary valve comprising:

a generally elongated cylindrical unitary body having first and second ends and a longitudinally extending axis of rotation and defining an intake port and an exhaust port;

said unitary body providing an intake passageway extending between said first end of said unitary body and said intake port and an exhaust passageway extending from said exhaust port to said second end of said unitary body;

said unitary body including a hollow cylindrical tube having an outer wall which defines said intake and exhaust ports and a dividing means for defining said intake and exhaust passageways within said cylindrical tube, said intake port having a predetermined port size and including expansion means for gradually increasing said port size as a rotational speed of said unitary body increases.

32. The rotary valve of claim 31 in which said intake port expansion means comprises a spring-loaded generally T-shaped flap having a stem extending into said outer wall of said unitary body and having a head portion defining an edge of said intake port.

33. In combination with an internal combustion engine of the type having an engine block defining at least one cylinder, at least one reciprocal piston mounted in said at least one cylinder, and a horizontally extending crankshaft which drives said at least one piston, said engine having a removable head connected to said engine block and defining a communication port over said at least one cylinder, wherein the improvement comprises:

a rotary valve rotatably mounted in said head and comprising a generally elongated cylindrical unitary body having a longitudinally extending axis of rotation and defining an intake port and an exhaust port positioned to periodically communicate with said communication port of said head when said unitary body is rotated, said axis of rotation of said rotary valve extending in a direction generally perpendicular to said crankshaft;

said unitary body defining an intake passageway extending between a first end of said unitary body and said intake port and an exhaust passageway extending between from said exhaust passageway extending from said exhaust port to a second end of said unitary body;

intake acceleration means disposed in said intake passageway for accelerating a flow of intake fluid through said intake passageway from said first end to said intake port; and exhaust acceleration means disposed in said exhaust passageway for accelerating a flow of exhaust fluid through said exhaust passageway from said exhaust port of said second end of said unitary body.

34. The rotary valve of claim 33 in which said intake acceleration means comprises a first generally helically-shaped blade disposed in said intake passageway and said exhaust acceleration means comprises a second generally helically-shaped blade disposed in said exhaust passageway.

35. The rotary valve of claim 34 in which said first and second blades extend along and are helically twisted about said axis of rotation of said rotary valve.

36. The rotary valve of claim 33 in which said engine block defines a plurality of cylinders, a plurality of pistons are mounted in said plurality of cylinders, and a plurality of said rotary valves are provided in said removable head, each of said rotary valves being positioned over one of said cylinders.

* * * * *